United States Patent [19]

Yamashita et al.

[11] Patent Number: 4,816,631

[45] Date of Patent: Mar. 28, 1989

[54] SLIDE SWITCH SIDEWAYS OPERATION ADAPTER

[75] Inventors: Masatsugu Yamashita, Kyoto; Takashi Yoshimura, Mishima; Shinichi Hashizume, Kusatsu; Hideyuki Bingo, Uji; Norio Iwakiri, Otokuni, all of Japan

[73] Assignee: Omron Tateisi Electronics Co., Kyoto, Japan

[21] Appl. No.: 5,338

[22] Filed: Jan. 15, 1987

Related U.S. Application Data

[63] Continuation of Ser. No. 655,210, Sep. 27, 1984.

[30] Foreign Application Priority Data

Sep. 29, 1983 [JP] Japan ..... 58-153075
Jun. 26, 1984 [JP] Japan ..... 59-96623

[51] Int. Cl.[4] ..... H01H 21/80
[52] U.S. Cl. ..... 200/332; 200/339
[58] Field of Search ..... 200/332, 335, 338, 339, 200/329, 330, 331, 16 R, 18, 307

[56] References Cited

U.S. PATENT DOCUMENTS 376,504 1/1975 Lockard ..... 200/153 J
3,912,886 10/1975 Allen ..... 200/11 A
4,389,549 6/1983 Brown ..... 200/339

FOREIGN PATENT DOCUMENTS 0043496 1/1982 European Pat. Off. .
2007264 9/1971 Fed. Rep. of Germany .
7142654 7/1972 Fed. Rep. of Germany .
3121659 12/1982 Fed. Rep. of Germany .
2386116 10/1978 France .

*Primary Examiner*—Renee S. Luebke
*Attorney, Agent, or Firm*—Stevens, Davis, Miller & Mosher

[57] ABSTRACT

A slide switch has a switch operating member at its upper surface which is slid back and forth for operating the slide switch. An adapter is provided for operating this slide switch from the side, and has a main body which has a base and clamp members extending from opposite sides of the base to define a space between them, the clamp members being adapted to grip the slide switch between them so as to secure the adapter on the top of the slide switch with the slide switch being held at least partly in the space between the clamp members. The adapter has an actuator pivotally fixed to the main body, and this actuator has a lever portion which protrudes out from the main body to the side and an actuation portion which, with the slide switch held between the clamp members, engages with the switch operating member of the slide switch, so as to slide it as the actuator is pivoted with respect to the main body. As a result, the slide switch, which ordinarily is for operation from its top, can be converted to be operated from its side.

20 Claims, 6 Drawing Sheets

SLIDE SWITCH SIDEWAYS OPERATION ADAPTER

This application is a continuation of application Ser. No. 655,210, filed Sept. 27, 1984.

BACKGROUND OF THE INVENTION

The present invention relates to an adapter for a slide switch, and in particular to an adapter which attaches to a slide switch for the purpose of operating it from the side.

Various types of slide switches such as DIP switches are per se known; one such is disclosed in copending patent application Ser. No. 651,761. Such a slide switch is typically mounted to a printed circuit board and is used for setting up data for the circuit on said printed circuit board by setting one or more sliding switch members of the slide switch, which typically are accessible only from its top or upper side which when it is thus mounted is exposed, i.e. on its side remote from said printed circuit board, to ON or OFF positions. If such a printed circuit board with such a slide switch mounted thereon is used singly or so that its face is easily accessible, then no problem arises with regard to setting the slide switch; but in the event that such a printed circuit board is stacked together with other printed circuit boards, or is otherwise in an inaccessible position, it becomes difficult or impossible to access the top side of the slide switch so as to set it.

Sometimes, it is practiced to pull out the printed circuit board bearing the slide switch from its position, in order to set the slide switch; but this is very disadvantageous, since it is troublesome and requires some skill on the part of the operator, and also there is a risk that the board may not be appropriately replaced back in its position. An alternative has been to use a different type of slide switch whose sliding switch members are accessible from its side, rather than from its top, and to mount such a slide switch at the edge of the printed circuit board; but to provide such an alternative type of side access slide switch, as well as the common or straightforward top access type of slide switch detailed above whose sliding switch members are accessed from its top or upper side when it is thus mounted, is costly and creates inventory load. Accordingly, this is not an economical solution to the slide switch side access problem.

SUMMARY OF THE INVENTION

Accordingly, it is the primary object of the present invention to provide an adapter which can be fitted to a slide switch which is made for being operated from the top, so as to operate said slide switch from sideways.

It is a further object of the present invention to provide such an adapter for operating a slide switch from sideways which can be easily fitted to said slide switch.

It is a further object of the present invention to provide such an adapter for operating a slide switch from sideways which eliminates any requirement for producing and stocking two different types of slide switch.

It is a further object of the present invention to provide such an adapter for operating a slide switch from sideways which obviates any necessity for disturbing printed circuit boards for slide switch operation.

It is a further object of the present invention to provide such an adapter for operating a slide switch from sideways which can be easily removed from said slide switch.

It is a further object of the present invention to provide such an adapter for operating a slide switch from sideways whose fitting to its slide switch is reliable and effective.

It is a further object of the present invention to provide such an adapter for operating a slide switch from sideways which has a good feeling during operation.

It is a yet further object of the present invention to provide such an adapter for operating a slide switch from sideways which provides a good detent action.

It is a yet further object of the present invention to provide such an adapter for operating a slide switch from sideways which is durable.

It is a yet further object of the present invention to provide such an adapter for operating a slide switch from sideways whose operating characteristics do not substantially alter with use.

It is a yet further object of the present invention to provide such an adapter for operating a slide switch from sideways which is easy to manufacture and assemble.

It is a yet further object of the present invention to provide such an adapter for operating a slide switch from sideways which is cheap.

It is a yet further object of the present invention to make it possible to reduce slide switch inventory.

According to the most general aspect of the present invention, these and other objects are accomplished by an adapter for operating from sideways a slide switch which has a switch operating member at its upper surface which is slid to and fro for operating said slide switch, comprising: (a) a main body, comprising: (b) a base; and (c) clamp members extending from opposite sides of said base to define a space between them, and adapted to grip said slide switch between them so as to secure said adapter on the top of said slide switch with said slide switch being held at least partly in said space between said clamp members; and (d) an actuator pivotally fixed to said main body, comprising: (e) a lever portion which protrudes out from said main body to the side; and (f) an actuation portion which, when said slide switch is thus held between said clamp members, is engaged to said switch operating member of said slide switch so as to slide it as said actuator is pivoted with respect to said main body.

According to such a structure, when said adapter is thus fitted to said slide switch with the clamp members holding it between them, then, by the operator simply pushing the end of said lever portion of said actuator, which projects out sideways from said adapter, up or down, the actuator may be rotated with respect to said main body of said adapter, thus causing its said actuation portion to slide said switch operating member of said slide switch to operate said slide switch. Accordingly, the slide switch can be converted from one which is operated from above, into a slide switch assembly for sideways operation, merely by fitting this adapter thereto; and accordingly no requirement arises for producing and stocking two different types of slide switch, or for disturbing printed circuit boards for slide switch operation. If the adapter is provided with an appropriate detent structure, there is then provided an adapter for operating a slide switch from sideways which has a good feeling during operation, and which provides a good detent action. Because of its simplicity, this adapter for operating a slide switch from sideways is easy to manufacture and assemble, and is cheap. Thus, it becomes possible to reduce slide switch inventory.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings, like parts and spaces and so on are denoted by like reference symbols in the various figures thereof; in the description, spatial terms are to be everywhere understood in terms of the relevant figure; and:

DESCRIPTION OF THE PREFERRED EMBODIMENTS

Figure 1:
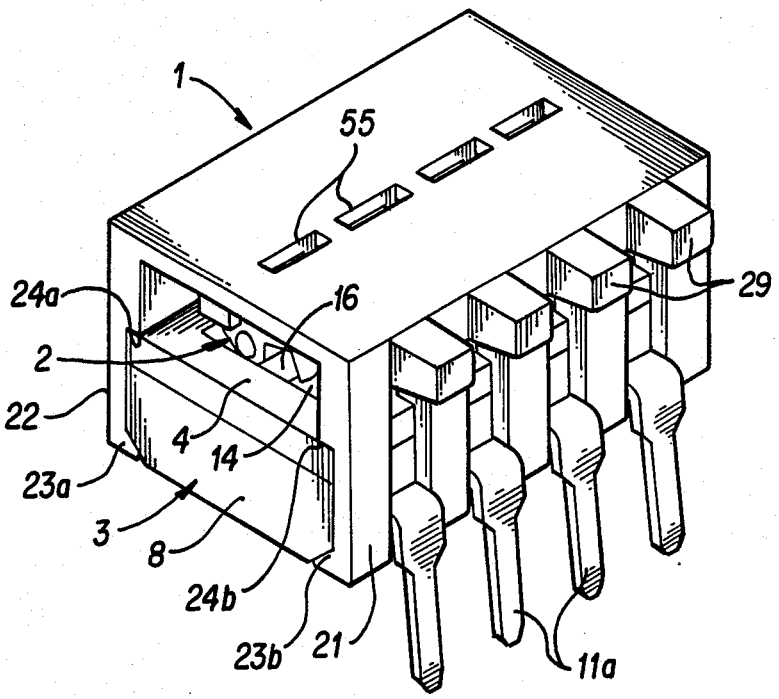
FIG. 1 is a perspective view showing the first preferred embodiment of the slide switch sideways operation adapter of the present invention as fitted to a slide switch, to constitute a side operated switch assembly.

Now, the first preferred embodiment 1 of the sideways operation adapter of the present invention, shown as fitted to the slide switch 3 in FIG. 1, in disassembled form in FIG. 2, and in sectional views in FIGS. 3 and 4, will be described in detail. This adapter 1 is made up from a body 50 and four switch actuators 2 which are pivoted to said body 50.

The body 50 has a main portion 40 of a generally rectangular shape, a side retainer wall portion 22 which extends from one of the long sides of this main portion 40 in a plane generally perpendicular to the plane of said main portion 40, and five retaining legs 21 which are arranged along the other of the long sides of said main portion 40 and extend therefrom in the direction generally perpendicular to its plane, substantially parallel to one another; four gaps 45, one for each of the individual switch assemblies of the slide switch 3, are thus defined between these five legs 21. The body 50 is made of a synthetic resin material, and thus the legs 21 and the side wall portion 22 have a certain inherent elasticity. The lower edge in the figures of the side wall portion 22, i.e. the edge remote from the main body portion 40, is formed with five retainer claws **23*a* extending in the inwards direction therefrom, the upper inner faces 23*c* of these claws 23*a* being sloped; and the lower ends in the figures of the legs 21, i.e. their ends remote from the main body portion 40, are formed with retainer claws 23*b* also extending in the inwards direction therefrom, the upper inner faces 23*d* of these claws 23*b* likewise being sloped. And the upper portion in the figures of the side wall portion 22, i.e. the portion thereof closer to the main body portion 40 of the body 50 of the adapter 1, is formed with a thickened portion 24*a* extending in the inwards direction therefrom, while the upper portions in the figures of the legs 21, i.e. the portions thereof closer to the main body portion 40, are likewise formed with thickened portions 24*b*** extending in the inwards direction therefrom.

Figure 3:
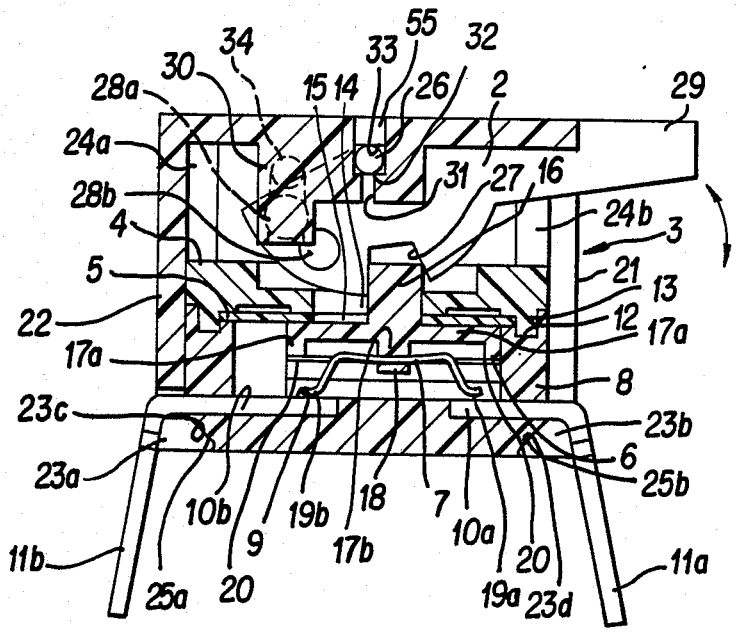
FIG. 3 is a sectional view of the switch assembly of FIG. 1, showing the manner of engagement of one of said actuator members with its individual switching assembly of the slide switch.
Figure 4:
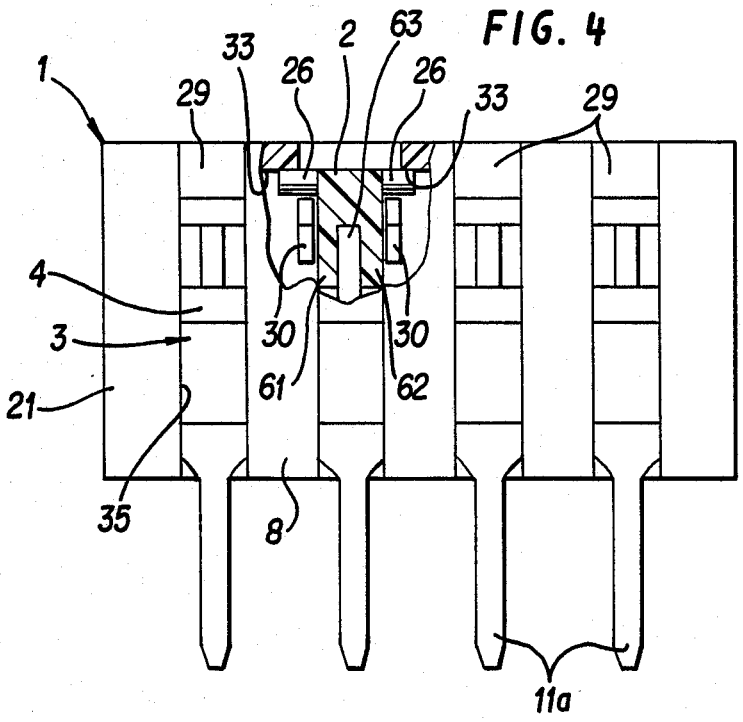
FIG. 4 is a side view of the switch assembly of FIG. 1, partially broken away to show the pivoting construction for one of the actuator members to the body of the actuator.

Thus, when the adapter 1 is to be fitted to the slide switch 3, the person doing the work prys the legs 21 and the side retainer wall portion 22 somewhat apart against their natural resilience, fits the slide switch 3 in between them upwards into the C-shaped space defined between them and the main portion 40 with the upper face of the cover plate 4 of the slide switch 3 facing towards said main portion 40, and pushes said slide switch 3 upwards in the sense of the figures into this C-shaped space, towards the main portion 40, until said upper face of the cover plate 4 comes into contact with the side remote from the main portion 40 of the thickened portion **24*a* of the side wall portion 22 and with the ends remote from the main portion 40 of the thickened portions 24*b* of the legs 21; and at this time the claws 23*a* and 23*b* respectively on said side wall portion 22 and said legs 21 snappingly fit around the housing 8 of the slide switch 3 with the aforesaid sloping inner faces 23*c* and 23*d* respectively of these claws 23*a* and 23*b* respectively fitting against sloping portions 25*a* and 25*b* of said housing 8, as shown in FIG. 3. Thereby, by the elastic force of the resilience of the legs 21 and the side wall portion 22, they squeeze the slide switch 3 in between them, thus holding it with respect to motion in the horizontal direction in FIG. 3 with respect to the adapter 1 as a whole; and the sliding of the sloping faces 23*c* and 25*a* against one another, as well as the sliding of the sloping faces 23*d* and 25*b* against one another, keeps the upper face of the cover plate 4 pressed against the thickened portions 24*a* and 24*b* of the side wall portion 22 and the legs 21 respectively, thus providing a positive positioning action for the slide switch 3 with respect to motion in the vertical direction in FIG. 3 with respect to the adapter 1 as a whole. Accordingly, the adapter 1 may be securely fitted to the slide switch 3 by a simple clipping action during assembly, and if required can subsequently be simply removed from said slide switch 3, by merely firmly pulling said adapter 1 away from said slide switch 3 upwards in FIG. 3, since in this event the aforesaid sliding of the sloping faces 23***c* and 25*a* against one another and of the sloping faces 23*d* and 25*b* against one another forces the legs 21 and the side retainer wall portion 22 somewhat apart against their natural resilience, so that the slide switch 3 can come out from between these members and so that the adapter 1 can be removed from said slide switch 3, without any need arising for the person performing such removal to pull the side wall portion 22 and the legs 21 apart by hand.

Figure 2:
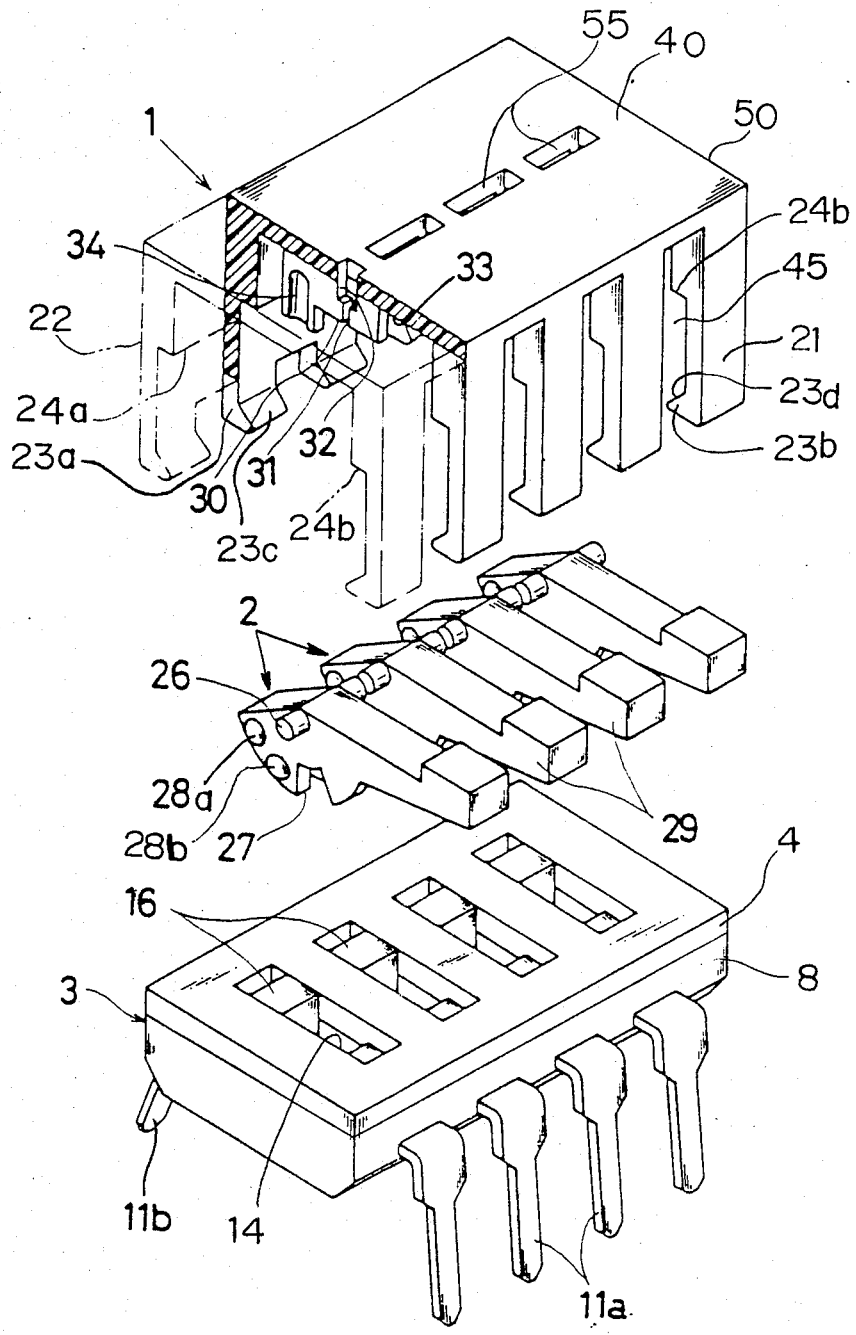
FIG. 2 is an exploded view of this assembly, showing the slide switch, the actuator members for the sideways operation adapter of the present invention, and the body of said sideways operation adapter, as separated from one another.

Each of the four switch actuators 2 is formed, as best seen in FIG. 2, with a generally sector shaped main portion 60 with pivot shafts 26 extending perpendicular to its plane on its either side from the center of the circle which defines its semicircular peripheral edge, and with an actuator lever 29 protruding in a generally radial direction from it. The main portion 60 is formed with an engagement notch 27 in its said semicircular peripheral edge, and, in this first preferred embodiment, with two hemispherical bumps or projections 28*a* and 28*b* on each of its sides near its said semicircular peripheral edge, for providing a detent action as will be explained later. And, as can best be seen in FIG. 4 which shows one of the actuators 2 as looking along and under its actuator lever 29, in this first preferred embodiment of the present invention the radially outer parts of the sector shaped main portions 60 of the actuators 2 are in fact divided by a gap 63 into two portions 61 and 62 overlapped in the axial direction; this is for aiding the detent action as will be explained later.

Each of these actuators 2 is pivoted to the body 50 of the adapter 1 by its two pivot shafts 26, with its actuator lever 29 extending out through one of the gaps 45 between two of the legs 21, as follows. To the inner surface of the main portion 40 of the body 50 of the adapter 1 and extending perpendicularly therefrom, at the approximate middle thereof with respect to its widthwise direction and one on either side in the lengthwise direction of said gap 45, there are fixed two pivot plates 30. Each of these pivot plates 30 is formed with a slot 31 which leads to a hole 32 wider, in this first preferred embodiment of the present invention, than said slot 31; and the pivot shafts 26 are fitted into these holes 32 against their bottoms 33, as best shown in FIG. 3, so that the sides of the slots 31 retain said pivot shafts 26 in said holes 32 while allowing them to rotate substantially freely, and thereby the actuators 2 are pivoted to the body 50 of the adapter 1, each opposing one of the individual switch units of the slide switch 3 fitted therein. And, in this first preferred embodiment, the inner sides of these pivot plates 30 are each formed with a depression 34 (see FIG. 2) which corresponds to one or the other 28*a* or 28*b* of the hemispherical bumps on the corresponding actuator 2, when said actuator 2 is in either of two particular rotational positions with respect to the body 50 of the adapter 1; this is for providing the aforementioned detent action.

Thus, when the adapter 1 for sideways operation is to be fitted to the slide switch 3, first each of the actuators 2 thereof is pivoted, for example, to its extreme position in the counterclockwise direction as shown in FIG. 3, so that its actuator lever 29 is raised to the maximum possible extent from the point of view of that figure as shown therein. At this time, as suggested in that figure, the hemispherical bump 28*a* on the main portion 60 of this actuator 2 corresponds to and falls into the depression 34 of the corresponding pivot plate 30, so that by a form of indexing action the actuator 2 is retained at its current angular position. And, corresponding to this position for the actuators 2, for each of the individual slide switch assemblies, the projecting push portion 16 of its slide member 6 is pushed to its extreme position to the right as seen in FIG. 3, i.e. to the ON position. And next the adapter 1 is fitted onto the slide switch 3 as explained above, by being lowered down onto said slide switch 3 which enters into the space between the legs 21 and the side retainer wall portion 22, and said adapter is clipped onto the slide switch 3 as explained above. As this is done, for each of the individual slide switch assemblies, the projecting push portion 16 of its slide member 6 enters into the engagement notch 27 in the semicircular peripheral edge of the corresponding one of the actuators 2, and is seated therein as shown in FIG. 3.

Now, during use of the adapter 1 and the slide switch 3, when it is desired to turn any one of the individual slide switch assemblies to the OFF state, then the operator presses the end of the corresponding actuator lever 29 in the downwards direction as seen in FIG. 3, so as to rotate the corresponding actuator 2 clockwise from the point of view of that figure, pushing the projecting push portion 16 of the corresponding slide member 6 to the left as seen in FIG. 3. When said slide member 6 reaches its extreme position to the left as seen in FIG. 3, i.e. its OFF position, then the actuator 2 will be pivoted to its extreme position in the clockwise direction from the point of view of FIG. 3, so that its actuator lever 29 is lowered to the maximum possible extent from the point of view of that figure. And, in this position, the other hemispherical bump 28*b* on the main portion 60 of this actuator 2 corresponds to and falls into the depression 34 of the pivot plate 30, so that again by a detent action the actuator 2 is retained at this OFF angular position.

And it will be understood that this action to switch any one of the individual slide switch assemblies from the ON position to the OFF position by using the corresponding actuator lever 29 can be reversed, by the operator pressing the end of the corresponding actuator lever 29 in the upwards direction as seen in FIG. 3, so as to rotate the corresponding actuator 2 counterclockwise from the point of view of that figure. Accordingly, it is seen that the slide switch 3, as a whole, can be operated from the side, to switch any one of its individual slide switch assemblies either ON or OFF, by the fitting of this adapter 1. Accordingly, there is provided according to the present invention an adapter 1 which, when it is fitted to a slide switch 3 with the members 21 and 22, which may be regarded as clamping members, holding said switch 3 between them, then, by the operator simply pushing the end of the lever portion 29 of an actuator 2, which projects out sideways from said adapter 1, up or down, the actuator 2 may be rotated with respect to the main body of said adapter 1, thus causing its actuation portion (the notch 27) to slide the switch operating member 16 of the corresponding individual switch assembly of said slide switch 3 to operate said slide switch 3. Accordingly, the slide switch 3 has been converted from one which is operated from above, into a slide switch assembly for sideways operation, by fitting this adapter 1 thereto; and accordingly no requirement arises for producing and stocking two different types of slide switch, or for disturbing printed circuit boards for slide switch operation by removing them from their places. Because of its simplicity, this adapter 1 for operating a slide switch from sideways is easy to manufacture and assemble, and is cheap. Thus, it becomes possible to reduce slide switch inventory.

And by the detent action of the hemispherical bumps 28*a* and 28*b* which cooperate with the depressions 34 of the pivot plates 30, each of these actuators 2 is retained with a certain force either at its extreme position in the clockwise direction which turns the corresponding individual slide switch assembly OFF, or at its extreme position in the counterclockwise direction which turns said corresponding individual slide switch assembly ON. This detent action is very important for providing a good feeling for the operation of the corresponding actuator lever 29, since, although as explained above in fact each of the individual slide switch assemblies may be provided with a detent mechanism internal to the slide switch 3, such a detent mechanism is typically appropriate in the strength of its detent action to the use of the slide switch 3 by itself as being actuated from above it, and would never be adequate for providing a good feeling for the sideways operating action provided by the adapter 1.

In the shown first preferred embodiment of the present invention, the fact that the radially outer parts of the sector shaped main portions 60 of the actuators 2 are each in fact divided by a gap 63 into two portions 61 and 62 overlapped in the axial direction, is very helpful for aiding this detent action, since otherwise the hemispherical bumps 28*a* and 28*b* would not easily be able to ride out of the depressions 34 of the pivot plates 30 during switching action; but because of the presence of the gaps 63 simple and relatively slight bending of said portions 61 and 62 is able to allow said bumps 28*a* and 28*b* to ride out of the depressions 34 of the pivot plates 30, if a sufficient force of reasonable magnitude is applied to rotate the corresponding actuator lever 29.

Figure 5:
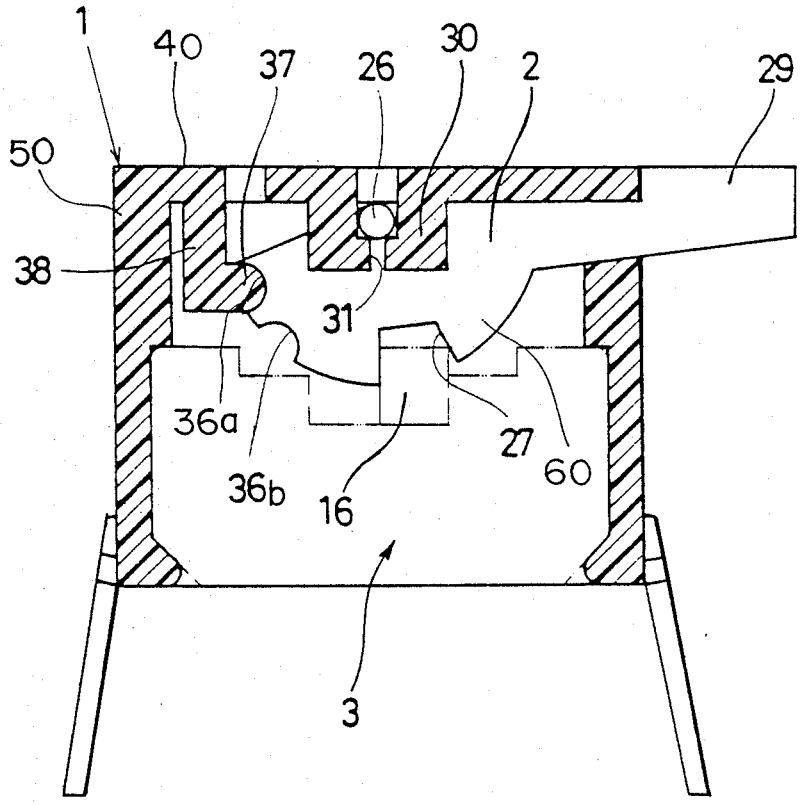
FIG. 5 is a schematic sectional view, relating to a second preferred embodiment of the slide switch sideways operation adapter of the present invention which has a different detent mechanism, similar to FIG. 3 but showing only parts which differ from parts shown in said previous figure, and similarly shows the engagement of one of the actuator members with its individual switching assembly of the slide switch.

Now, in FIG. 5, there is shown, again as fitted to a slide switch, a second preferred embodiment of the slide switch sideways operation adapter of the present invention which has a different detent mechanism from that of the first preferred embodiment described above; in this figure, which is a sectional view corresponding to the view of FIG. 3 with respect to the first preferred embodiment, like parts both of the adapter and of the slide switch are denoted by like reference symbols as in the description of said first embodiment, and only parts of said second preferred embodiment which substantially differ from parts shown in the previous figures are shown.

In this second preferred embodiment, rather than the two hemispherical bumps 28*a* and 28*b* being provided on the side of each of the sector shaped main portions 60 of the actuators 2 as was the case in the first preferred embodiment, two notches 36*a* and 36*b* are provided in the semicircular edge of each of said sector shaped main portions 60; these notches are substantially semicircular in shape, in the shown construction, but this is not to be considered as being limiting. Corresponding to this, rather than each of the pivot plates 30 being made with a depression 34, for each of the actuators 2 there is provided an extension member 38 (in the shown construction formed integrally with the main body 50 of the adapter 1) which has an indexing knob 37 formed on its end which is pressed against the semicircular edge of each of said sector shaped main portions 60 by the inherent elasticity of said extension member 38. Accordingly, this detent construction functions in a manner, which will be easily understood by one of ordinary skill in the art based upon the previous descriptions herein, to retain each of the actuators 2 with a certain force either at its extreme position in the clockwise direction which turns the corresponding individual slide switch assembly OFF, in which case the indexing knob 37 is resting in the notch 36*b* of the actuator 2, or at its extreme position in the counterclockwise direction which turns said corresponding individual slide switch assembly ON, in which case the indexing knob 37 is resting in the other notch 36*a* of said actuator 2. Further, each of the actuators 2 can be shifted between its said two extreme positions by the application of a certain amount of rotational force thereto so as to bent the extension member 38 somewhat, to force its indexing knob 37 to come out of the one of the notches 36*a*, 36*b* in which it currently is. And in this second preferred embodiment there is no need for the radially outer parts of the sector shaped main portions 60 of the actuators 2 to be divided by gaps into two portions overlapped in the axial direction, as was the case in the first preferred embodiment, at least from the point of view of the detent action, although such a construction may be otherwise helpful, e.g. from the point of view of manufacturing convenience.

Figure 6:
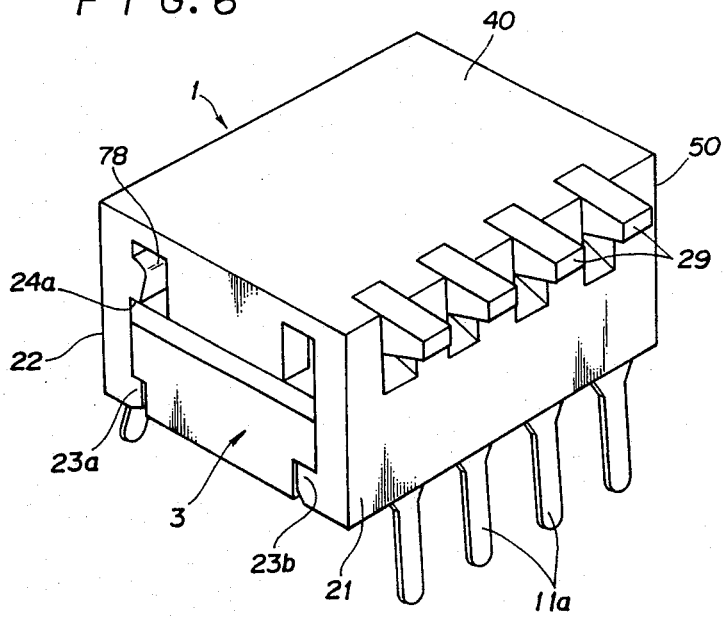
FIG. 6 is a perspective view, similar to FIG. 1, showing the third preferred embodiment of the slide switch sideways operation adapter of the present invention, which again has a different detent mechanism as well as other differences from the first preferred embodiment, as fitted to a slide switch, to constitute a side operated switch assembly.
Figure 8:
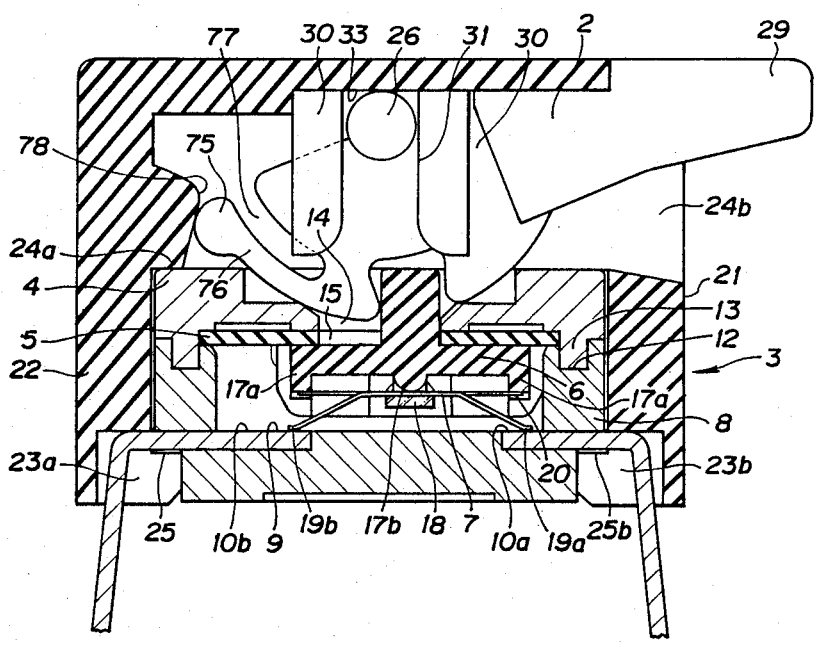
FIG. 8 is similarly to FIG. 3 which refers to the first preferred embodiment, a sectional view of the switch assembly of FIG. 6, showing the manner of engagement of one of said actuator members with its individual switching assembly of the slide switch.
Figure 7:
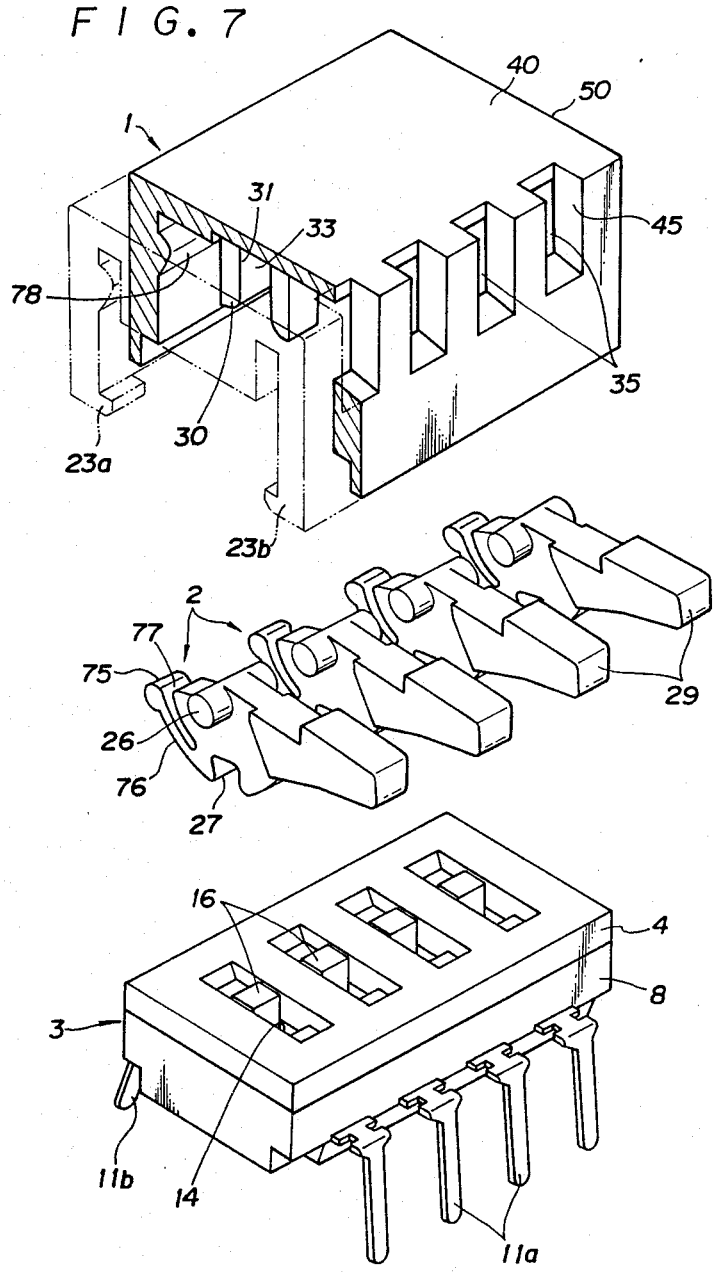
FIG. 7 is an exploded view of this assembly, similar to FIG. 2 which refers to the first preferred embodiment, showing the slide switch, the actuator members for the sideways operation adapter of the present invention, and the body of said sideways operation adapter, as separated from one another.

Now, in FIGS. 6, 7, and 8, which are similar, respectively, to FIGS. 1, 2, and 3 relating to the first preferred embodiment, there is shown, again as fitted to a slide switch, a third preferred embodiment of the slide switch sideways operation adapter of the present invention which has yet another different detent mechanism from that of the first preferred embodiment described above, and also has some other differences; in these figures, like parts both of the adapter and of the slide switch are denoted by like reference symbols as in the description of said first embodiment.

In this third preferred embodiment, the detent mechanism for each of the actuators 2 for actuating the individual slide switch assemblies from sideways is provided by the following construction. The part of the sector shaped main portion 60 of each of the actuators 2 remote from its actuator lever 29 is cut with a circumferentially extending slot 77, so as to form a generally circumferentially extending prong 76; and a knob 75 is formed on the end of this prong 76. Corresponding to this, for each of the actuators 2 there is provided an oblate bump 78 formed on the inside of the side retainer wall portion 22 which is kept pressed against the semicircular edge of said circumferentially extending prong 76 by the inherent elasticity of said prong 76. Accordingly, this detent construction functions in a manner, which again will be easily understood by one of ordinary skill in the art based upon the previous descriptions herein, to retain each of the actuators 2 with a certain force either at its extreme position in the clockwise direction which turns the corresponding individual slide switch assembly OFF, in which case the knob 75 of the prong 76 is resting against the upper side of the bump 78 in FIG. 8, or at its extreme position in the counterclockwise direction as shown in FIG. 8 which turns said corresponding individual slide switch assembly ON, in which case the knob 75 of the prong 76 is resting against the lower side of the bump 78 in FIG. 8. Further, each of the actuators 2 can be shifted between its said two extreme positions by the application of a certain amount of rotational force thereto so as to bent the prong 76 somewhat, to force its knob 75 to come over the bump 78 from the side thereof on which it currently is to the other side thereof. And again in this third preferred embodiment there is no need for the radially outer parts of the sector shaped main portions 60 of the actuators 2 to be divided by gaps into two portions overlapped in the axial direction, as was the case in the first preferred embodiment, at least from the point of view of the detent action, although such a construction may be otherwise helpful, e.g. from the point of view of manufacturing convenience.

This third preferred embodiment has the advantage over the first preferred embodiment that the wear on the detent mechanism made up by the prong 76 and the oblate bump 78 will be much less than the wear on the hemispherical projections 28*a* and 28*b* of the detent mechanism of the first embodiment, since these projections 28*a* and 28*b* are rubbing against the pivot plates 30 during all of the rotation of the actuator 2 with respect to the body 50 of the adapter, while in the case of the third preferred embodiment the knob 75 on the end of the prong 76 only rubs against the oblate bump 78 when traveling over it. Thus, the detent action varies with time and with intensity of use of the slide switch 3 and the adapter 1, much more slowly, than in the case of the first preferred embodiment.

Further, it should be noted that in this third preferred embodiment the width of the slot 31 is uniform from its top to its bottom, being substantially as wide as the pivot shafts 26 of the actuators 2 all along its depth, rather than being narrower than them at its top and approximately as wide as them only at its bottom as was the case in the first and second preferred embodiments. This makes it easier to assemble the adapter 1, before it is fitted to the slide switch 3, than in the case of the first preferred embodiment, because there is no requirement to bend the slots 31 open in order to force the pivot shafts 26 of the actuators 2 into them to their bottoms to rest therein. Now, it might be thought that in this third preferred embodiment, when the adapter 1 was being fitted onto the slide switch 3, there might be a danger that the actuators 2 should fall out from the adapter 1, since their pivot shafts 26 are not forcibly retained in the slots 31. However, in this case, the detent construction including the prong 76 and the bump 78 functions to hold the actuators 2 in place, as will be clear to one of ordinary skill in the art based upon the disclosure herein.

Yet further, it should be noted that in this third preferred embodiment, the lower clawed ends 23 of the members 21 and 22 are not formed in the sloped shapes 23*c* and 23*d* as in the case of the first preferred embodiment, but are cut off straight, so that, when these clamp members are gripping the slide switch 3, they are not biased apart, when the adapter 1 is pulled upwards away from the slide switch 3. Accordingly, the fixing of the adapter 1 on the slide switch 3 is more definite and certain, than in the case of the first preferred embodiment. This may or may not be desirable, depending upon circumstances.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. An adapter for operating a slide switch using sideways motion, said slide switch having a switch operating member which is slidable to operate said slide switch, said adapter comprising:

(a) a main body comprising (i) a base and (ii) first and second clamp means extending from opposite sides of said base, said first and second clamp means gripping said slide switch therebetween to secure said adapter above said slide switch with said slide switch being held at least partially in a space between said first and second clamp means; and (b) an actuator pivotably attached to said main body, said actuator comprising (i) a lever portion projecting out of one side of said main body and oriented in at least one operative position in a direction substantially parallel to a sliding direction of said switch operating member, and (ii) an actuating portion engaged with said switch operating member, said actuating portion causing said switch operating member to slide when said actuator is pivoted relative to said main body.

2. An adapter for operating a slide switch according to claim 1, wherein said clamp means are adapted to grip said slide switch by their own elasticity.

3. An adapter for operating a slide switch according to claim 2, wherein said clamp means are formed with sloping surfaces on their end portions which, when said clamp means are thus gripping said slide switch, bias said slide switch towards said base of said main body of said adapter.

4. An adapter for operating a slide switch according to claim 2, wherein said clamp means are formed with retainer end portions which, when said clamp means are thus gripping said slide switch, do not bias said clamp means apart when said adapter is pulled upwards away from said slide switch.

5. An adapter for operating a slide switch according to claim 1, wherein said actuator is formed with a plurality of detent projections which bear against a detent indentation formed in said main body of said adapter, so as to provide a detent action for the movement of said actuator.

6. An adapter for operating a slide switch according to claim 5, wherein said detent projections are formed on the side of said actuator.

7. An adapter for operating a slide switch according to claim 1, wherein said actuator is formed with a plurality of detent notches and said main body of said adapter is formed with a detent projection, said detent notches and said detent projection cooperating together so as to provide a detent action for the movement of said actuator.

8. An adapter for operating a slide switch according to claim 7, wherein said detent projection is flexible.

9. An adapter for operating a slide switch according to claim 1, wherein said actuator is formed with a detent projection and said main body of said adapter is formed with a bump, said bump and said detent projection cooperating together so as to provide a detent action for the movement of said actuator.

10. An adapter for operating a slide switch according to claim 9, wherein said detent projection is flexible.

11. An adapter for operating a slide switch according to claim 10, wherein said detent projection is curved.

12. An adapter for operation slide switch according to claim 1, wherein said actuator is formed with a plurality of shaft projections for being pivoted to said main body of said adapter, and said main body of said adapter is formed with slots into which said shaft projections are inserted and against the bottom of which they are biased to pivot said actuator to said adapter.

13. An adapter for operating a slide switch according to claim 12, wherein said slots are narrower than said shaft projections at their entrance portions.

14. An adapter for operating a slide switch according to claim 13, wherein said slots are of substantially the same width as said shaft projections at their bottom portions.

15. An adapter for operating a slide switch according to claim 12, wherein said slots are of substantially the same width as said shaft projections at their entrance portions.

16. An adapter for operating a slide switch according to claim 15, wherein said slots are of substantially the same width as said shaft projections at their bottom portions.

17. An adapter for operating a slide switch using sideways motion, said slide switch having a switch operating member which is slidable to operate said slide switch, said adapter comprising:

(a) a main body comprising (i) a base and (ii) first and second clamp means extending from opposite sides of said base, said first and second clamp means gripping said slide switch therebetween to secure said adapter above said slide switch with said slide switch being held at least partially in a space between said first and second clamp means; and (b) an actuator pivotably attached to said main body, said actuator comprising (i) a lever portion projecting out of one side of said main body and oriented in at least one operative position in a direction substantially parallel to a sliding direction of said switch operating member, and (ii) an actuating portion engaged with said switch operating member, and actuating portion causing said switch operating member to slide when said actuator is pivoted relative to said main body, said actuator being formed with a flexible curved detent projection and said main body of said adapter being formed with a bump, said bump and said detent projection cooperating together so as to provide a detent action for movement of said actuator, wherein said detent projection is substantially a circular arcuate-shaped prong member the center of which is located at the pivot point of said actuator relative to said main body of said adapter.

18. An adapter for operating a slide switch according to claim 17, wherein said first and second clamp means include elongated projections having flat ends.

19. An adapter for operating a slide switch according to claim 17, wherein said actuator includes a sector-shaped main portion, a part of said main portion remote from said lever portion including a substantially circumferentially extending slot to form said flexible curved detent projection, said detent projection being substantially circumferentially extending and having a formed on its free end, said bump being disposed on an inside surface of a side retainer wall portion of said main body, said knob being pressed against said bump via inherent elasticity of said projection, said actuator being maintained at a first extreme position by said knob resting against an upper side of said bump and a second extreme position by said knob resting against an underside of said bump, and said knob coming over the surface of said bump while said projection elastically bends to move between said first extreme position and said second extreme position responsive to pivoting movement of said actuator with respect to said main body.

20. An adapter for operating a slide switch according to claim 19, wherein said main body includes pivot plate means having a slot with a uniform width from its top to its bottom, said actuator including a pivot shaft disposed in said slot to pivotably attach said actuator to said main body.

* * * * *